US009498814B2

(12) United States Patent
Sikora et al.

(10) Patent No.: US 9,498,814 B2
(45) Date of Patent: Nov. 22, 2016

(54) METHOD AND DEVICE FOR PRODUCING A SHAPED COMPONENT

(71) Applicant: THYSSENKRUPP STEEL EUROPE AG, Duisburg (DE)

(72) Inventors: Sascha Sikora, Lünen (DE); Jörg Gorschlüter, Hamm (DE)

(73) Assignee: THYSSENKRUPP STEEL EUROPE AG, Duisburg (DE)

( * ) Notice: Subject to any disclaimer, the term of this patent is extended or adjusted under 35 U.S.C. 154(b) by 0 days.

(21) Appl. No.: 14/893,770

(22) PCT Filed: May 21, 2014

(86) PCT No.: PCT/EP2014/060419

§ 371 (c)(1),
(2) Date: Nov. 24, 2015

(87) PCT Pub. No.: WO2014/187852

PCT Pub. Date: Nov. 27, 2014

(65) Prior Publication Data

US 2016/0101456 A1 Apr. 14, 2016

(30) Foreign Application Priority Data

May 24, 2013 (DE) ..... 10 2013 105 361

(51) Int. Cl.

| | |
|---|---|
| ***B21D 26/02*** | (2011.01) |
| ***B21D 26/033*** | (2011.01) |
| ***B21D 26/045*** | (2011.01) |
| ***B21D 37/16*** | (2006.01) |

(52) U.S. Cl.
CPC ..... *B21D 26/033* (2013.01); *B21D 26/045* (2013.01); *B21D 37/16* (2013.01)

(58) Field of Classification Search
CPC ... B21D 26/033; B21D 26/045; B21D 37/16
USPC ..... 72/61
See application file for complete search history.

(56) References Cited

U.S. PATENT DOCUMENTS 6,261,392 B1 7/2001 Sundgren et al.

FOREIGN PATENT DOCUMENTS

| | | | |
|---|---|---|---|
| DE | 19642824 | A1 | 4/1998 |
| DE | 10012974 | C1 | 3/2001 |
| DE | 69803588 | T2 | 6/2002 |
| DE | 102011102800 | B4 | 7/2014 |
| JP | 2009220141 | A | 10/2009 |

OTHER PUBLICATIONS

English Machine Translation of DE 69803588 from EPO, pp. 1-7.*
German Language International Search Report for International patent application No. PCT/EP2014/060419; mailing date Jul. 23, 2014.

(Continued)

*Primary Examiner* — David B Jones
(74) *Attorney, Agent, or Firm* — thyssenkrupp North America, Inc.

(57) ABSTRACT

Example methods and devices for producing a shaped component may involve positioning a workpiece having a hollow region and consisting at least partially of steel in a mold of a device. One or more docking punches may secure the workpiece within the mold and serve to introduce a pressurized fluid into the hollow region of the workpiece within the mold. The workpiece may be hot-formed in this process. The present disclosure concerns a variety of methods and devices that may be utilized to counteract a cooling of the workpiece in a region of the docking punch and reduce a temperature difference that may exist between the workpiece and the device.

15 Claims, 3 Drawing Sheets

(56) References Cited

OTHER PUBLICATIONS

English translation of International Search Report for International patent application No. PCT/EP2014/060419; mailing date Jul. 23, 2014.

English translation of the abstract of JP 2009220141 A.

English translation of the abstract of DE 19642824 A.

English translation of the abstract of DE 102011102800 B4.

English translation of the abstract of DE 10012974 C1.

* cited by examiner

METHOD AND DEVICE FOR PRODUCING A SHAPED COMPONENT

CROSS REFERENCE TO RELATED APPLICATIONS

This application is a U.S. National Stage Entry of International Patent Application Serial Number PCT/EP2014/060419, filed May 21, 2014, which claims priority to German Patent Application No. DE 102013105361.0 filed May 24, 2013, the entire contents of both of which are incorporated herein by reference.

FIELD

The present disclosure relates to methods and devices for producing shaped components.

BACKGROUND

It is known from the prior art to harden workpieces of steel, such as tubes or blanks, or the components produced therefrom, such as for instance profiles, during or after they have undergone forming. In this case, depending on the steel material, the workpieces or components are brought to a temperature above the Ac1 or Ac3 temperature, so that a substantially austenitic microstructure is obtained, and are subsequently cooled or quenched. The martensitic microstructure thus obtained then gives the component an increased hardness, so that comparatively stable components can be produced in spite of low weight.

In particular in the industrial-scale production of hardened profiles, especially hollow profiles, in the past only comparatively simple geometries have been implemented. More complex geometries, on the other hand, can be achieved for example by the profiles being put together from a number of parts, for instance half-shells. However, the stability, weight and production process of the profile may be adversely influenced by the required connection of the parts to form a profile.

Another approach that allows components such as profiles with a more complex structure to be produced is taken by what is known as hot blowforming. In the case of hot blowforming, a hot, generally gaseous fluid is introduced under pressure by a docking punch into a hollow region of the workpiece that is sealed off by the docking punch, for instance into the interior of a tube. The fluid introduced under high pressure presses the workpiece against an outer shaping mold (known as high-pressure hydroforming) and/or the outer shaping mold is pressed against the workpiece that is under moderate pressure (known as low pressure hydroforming). In the latter case, the fluid introduced serves for fixing a certain volume in the hollow region of the workpiece, in order to allow the workpiece then to undergo forming from the outside by the mold.

If the component produced is to be hardened, the component can be hardened in a separate process step. However, this represents a comparatively cost-intensive solution for being able to provide hardened profiles with complex geometries. Therefore, the prior art has taken the approach of performing the hot blowforming and hardening in one device.

Methods and devices that are suitable for this are known for example from the prior art of DE 698 03 588 T2. It is proposed to hydroform a hollow steel workpiece with a heated pressurized medium and subsequently quench it in the forming mold, by the dominant heated medium being replaced by a pressurized cool medium.

An improvement of the production process of hardened components with complex geometries can be achieved in this way. However, it has been found that prior-art components produced in this way are not of a satisfactory quality, in particular in their end regions, that is to say where the fluids are introduced into the hollow region of the workpiece. As a result, it is particularly not possible to provide a profile that is completely hardened throughout its entire length. The workability of the workpiece in these regions is also unsatisfactory, and so premature material failure can occur. For this reason, the ends of such components or profiles are generally removed after the forming or hardening, which however leads to a high amount of reject material or scrap and consequently impairs the cost-effectiveness of the method.

DETAILED DESCRIPTION

Figure 1:
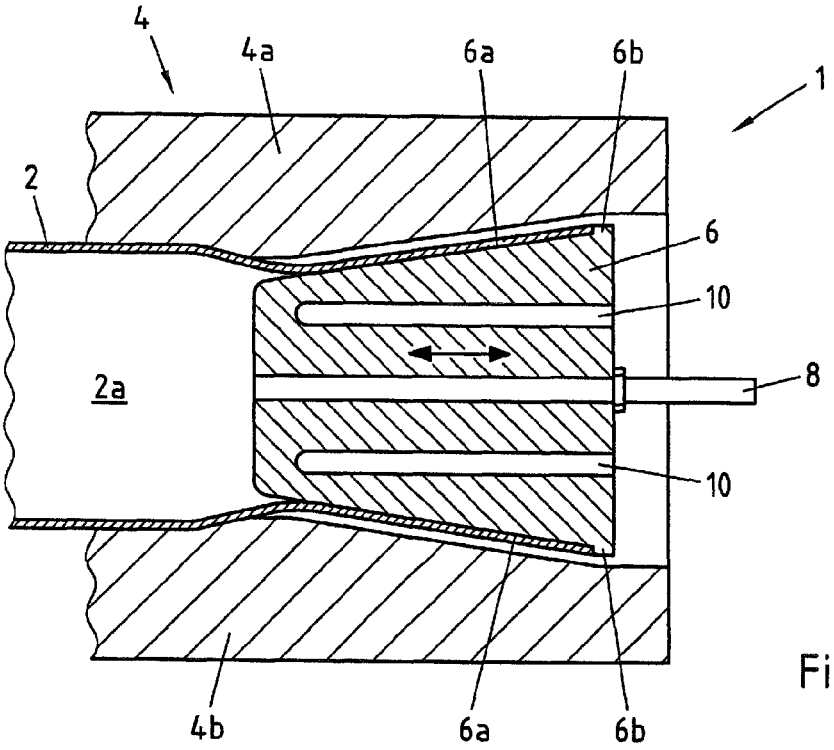
FIG. 1 is a sectional view of an example device used for producing a shaped component.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

Against this background, the object of the present invention is to provide a method and a device that allow the cost-effective production of components even with a complex geometry and at the same time make satisfactory hardening of the components possible. To that end, example methods and devices are disclosed for producing a shaped component from a workpiece having a hollow region and consisting at least partially of a steel material. In some examples, the workpiece may be introduced into a mold and a fluid may be introduced under pressure by a docking punch into the hollow region of the workpiece located in the mold, and the workpiece may be hot-formed.

The aforementioned object is achieved according to a first teaching of the present invention by a method of the type in question in that, in the region of the docking punch, the cooling of the workpiece is counteracted, in particular during the hot forming. The cooling can in this case be counteracted both by additional means and by the device itself.

It has been found that the presence of the docking punch or the device in the region of the docking punch itself is responsible for the aforementioned disadvantages, since, due to the contact of the docking punch or the device with the workpiece in order to introduce the fluid under pressure into the hollow region of the workpiece and to form the workpiece, part of the heat is removed from the workpiece in the region of the docking punch by way of the docking punch. As a result, the temperature of the workpiece in the region of the docking punch and also in adjacent regions of the workpiece can be reduced during the hot forming, or a sufficiently high temperature may not be reached in the first place. The desired temperature profile of the workpiece when heating up to above the Ac1 or Ac3 temperature, subsequently carrying out hot forming, preferably at temperatures above the Ac1 or Ac3 temperature of the steel material, and then performing rapid cooling is impaired as a result.

The fact that the cooling of the workpiece in the region of the docking punch is then counteracted means that the disadvantageous effect of an undesired temperature profile of the workpiece in the region of the docking punch can be reduced or minimized. Consequently, satisfactory workability can also be achieved in the region of the docking punch and a substantially completely full-hardened component can be produced, so that reject material in the region of the docking punch can be reduced or even avoided. At the same time, the advantages of blowforming, that is to say the production even of complex geometries, can be exploited. It has also been found that the method according to the invention is conducive to a displacement of the material of the workpiece out of the regions of the docking punch and high degrees of forming can be achieved.

The result is that a method that allows the cost-effective production of components even with a complex geometry and at the same time makes satisfactory hardening of the components possible can be provided.

Counteracting the cooling of the workpiece is understood in particular as meaning that the cooling is counteracted to the extent that a cooling-induced phase transformation in the workpiece, in particular during the hot forming of the workpiece, can be substantially prevented. The workpiece temperature can therefore be kept above the recrystallization temperature or the Ac1 temperature or even the Ac3 temperature of the steel material also in the region of the docking punch.

The workpieces are generally semifinished products that can be formed into a component, in particular into a profile. With particular preference, the workpieces are tubular workpieces, which can be formed into a tubular profile. The tubular workpieces may for example have two openings, for example one at each end. In this case, a docking punch may be provided for each opening of the workpiece. However, it is also conceivable to use workpieces with one opening or more than two openings. In this case, a corresponding number of docking punches may be provided. The components produced, in particular tubular profiles, are suitable in particular as body components, for instance as pillars or supports of a vehicle body. The advantages that can be achieved by the method according to the invention, such as high stiffness of the components along with low weight and cost-effective production, are particularly desired in the automobile sector.

The steel material of the workpiece may for example be a manganese-boron steel. Depending on the alloy, these steels can achieve tensile strengths of over 1500 MPa to 2000 MPa by hardening.

In addition, workpieces that have a wall thickness of between 0.5 and 3.0 mm are preferred for the method according to the invention.

The fluid used for the shaping preferably has a temperature above the Ac1 or Ac3 temperature of the steel material of the workpiece. The fluid is preferably a gas, but in principle a liquid may also be provided. Excessive cooling of the workpiece during the hot forming can be counteracted by a sufficiently high temperature of the fluid.

Alternatively, the fluid may also be introduced into the workpiece without undergoing temperature control, for example at room temperature. In particular, fluids with low thermal conductivity are particularly well-suited, since excessive cooling of the workpiece does not occur, at least for the time of the hot forming.

The workpiece may for example be brought to a temperature for the hot forming, that is to say to a temperature above the recrystallization temperature, preferably to a temperature above the Ac1 or Ac3 temperature of the steel material, before being introduced into the mold or else only once it is in the device itself.

The mold preferably engages at least partially around the workpiece. For example, the mold is formed as a die. For example, the mold comprises two die halves, into which the workpiece can be introduced. The mold is preferably a shaping mold and has for example at least in certain portions a negative form of the component to be produced.

The docking punch preferably has on its outer circumferential surface a sealing region, by way of which the hollow region of the workpiece is sealed off with respect to the outer region. Dependent on the geometry of the workpiece to be formed, two or more docking punches may also be provided. The docking punch may have the additional function of displacing material of the workpiece during the hot forming. In the case of more than one docking punch, the cooling of the workpiece may be counteracted in the region of all the docking punches or only individual ones.

The hot forming in the device may be achieved on the one hand by the pressure of the fluid introduced into the hollow region of the workpiece itself already being sufficient to achieve a forming of the workpiece. In this case, a substantially outwardly directed forming force presses the workpiece against the mold. A mold formed as a die thereby generally encloses the workpiece completely before the fluid is introduced under high pressure into the hollow region of the workpiece. On the other hand, the fluid introduced under pressure may also serve the purpose of fixing a certain volume in the hollow region of the workpiece. The forming may then be performed from the outside, for example by the mold of the device. A mold formed as a die in this case only closes completely once the fluid has been introduced under moderate pressure. In principle, a combination of the aforementioned methods may also be used.

According to a refinement of the method according to the invention, the cooling is counteracted in that the workpiece in the mold is heated at least for a time in the region of the docking punch. For this purpose, the device may for example have means for heating the workpiece in the region of the docking punch, for example in the mold or in the docking punch. It has been found that, by heating the workpiece in the region of the docking punch, in particular during the hot forming, excessive or overly rapid cooling of the workpiece in this region can be sufficiently counteracted in spite of a simultaneous removal of heat by way of the device, for instance the docking punch.

According to a further refinement of the method according to the invention, the cooling is counteracted in that the heat transfer from the workpiece to the device in the region of the docking punch is reduced. It has been found that excessive or overly rapid cooling of the workpiece in the region of the docking punch can also be counteracted by reducing the heat transfer from the workpiece to the device. That the heat transfer to the device is reduced means for example that the heat transfer to the mold in the region of the docking punch and/or to the docking punch itself is reduced.

According to a next refinement of the method according to the invention, the heat transfer is reduced in that the thermal conductivity of the device in the region of the docking punch is reduced. By reducing the thermal conductivity of the device in the region of the docking punch, the heat transfer can be counteracted in spite of a possibly existing difference in temperature between the device in the region of the docking punch and the workpiece in the region of the docking punch. In this case, for example, the thermal conductivity of the docking punch itself and/or the thermal conductivity of the mold in the region of the docking punch may be reduced. For example, the thermal conductivity may be reduced in comparison with regions of the mold that are away from the docking punch. In particular, this can be achieved in that a device (for example the mold or the docking punch) comprising a material with low thermal conductivity is used in the region of the docking punch. For example, a docking punch substantially consisting of a material with low thermal conductivity and/or a mold comprising a material with low thermal conductivity in the region of the docking punch may be used. The material with low thermal conductivity may for example be a tool steel with low thermal conductivity. However, other materials, such as for example ceramic, are also conceivable.

A reduced thermal conductivity or a material with low thermal conductivity is understood in particular as meaning a thermal conductivity that is lower than that of the steel material used. For example, the thermal conductivity of the material with low thermal conductivity is lower than 40, preferably lower than 30 or even lower than 20 W/(m*K).

If according to a further refinement of the method according to the invention the heat transfer is reduced in that an additive is introduced between the workpiece and the device, in particular the mold, a reduction of the heat transfer can be achieved without major modifications of the device. For example, a lubricant, a cellulose or a ceramic may be provided between the device and the workpiece in the region of the docking punch. As a result, the thermal conductivity, and consequently the heat transfer to the device, are further reduced. If the additive is provided between the workpiece and the device, the sealing between the workpiece and the docking punch is also not impaired. The additive may for example be introduced with the workpiece into the device or already be provided in the device.

With preference, the additive has a low thermal conductivity, in particular a lower thermal conductivity than the steel material used for the workpiece and/or than the material of the device in the region of the docking punch. For example, the thermal conductivity of the additive is lower than 20, preferably lower than 10 or even lower than 1 W/(m*K).

According to a further refinement of the method according to the invention, the heat transfer is reduced by a reduction of the contact area between the workpiece and the device, in particular by a geometrical modification of the surface of the docking punch, preferably by a structuring, in particular one or more clearances. Alternatively or in addition, the mold may also be geometrically modified in such a way in the region of the docking punch. Thus, the thermal conductivity, and consequently the heat transfer from the workpiece to the device, may be reduced by way of reducing the contact area between the device and the workpiece, so that ultimately the cooling of the workpiece in the region of the docking punch can be counteracted. It is often not possible to position additional substances, in particular between the workpiece and the docking punch, without impairing the sealing function of the docking punch. However, it has been found that a reduction of the contact area, such as by providing one or more clearances on the surface of the docking punch, allows the heat transfer to be reduced even in the sealing region of the docking punch, and nevertheless sufficient sealing for the forming, such as the hot blowforming, to be established. A modification allows the contact between the device and the workpiece to be reduced in a particularly easy way, wherein the air that is preferably provided in the clearances can serve as an insulating medium. A reduction of the contact area is understood for example as meaning that the contact area is reduced in comparison with a contact area without geometrical modification of the surface by at least 20%, preferably by at least 40%, with particular preference by at least 60%.

According to a further refinement of the method according to the invention, the heat transfer is reduced in that the temperature difference between the device and the workpiece is reduced in the region of the docking punch. As a result, the heat transfer can be reduced in spite of possibly high thermal conductivities of the materials used. A restriction to the use of materials with low thermal conductivity or additives can in this way be obviated, so that a greater freedom in the design of the device can be achieved. It is of course also possible in principle to minimize the heat transfer both by reducing the thermal conductivity and by reducing the temperature difference.

Reducing the temperature difference is understood as meaning that at least a positive temperature difference between the device and the workpiece is reduced in the region of the docking punch (if that is the temperature of the workpiece in the region of the docking punch is greater than the temperature of the device in the region of the docking punch). This is so because such an excessive positive temperature difference leads to a reduction of the temperature in the workpiece, so that a displacement of the material during the forming or a quenching of a sufficiently high workpiece temperature, and consequently hardening, is impaired. In an optimum case, the temperatures of the device and the workpiece in the region of the docking punch are therefore substantially the same during the hot forming.

According to a further refinement of the method according to the invention, the temperature difference is reduced by controlling the temperature of the device, in particular the docking punch and/or the mold, in the region of the docking punch. This allows the temperature difference in the relevant regions to be reduced particularly easily and efficiently. Such temperature-controlled regions may for example have heating elements. In particular, the Ac1 temperature or even the Ac3 temperature of the steel material can be achieved by the temperature control. As a result, the workpiece can be kept above the recrystallization temperature or above the Ac1 temperature or even the Ac3 temperature in the region of the docking punch during the hot forming. For example, the docking punch or the mold is heated up to an appropriate temperature in the region of the docking punch before and/or during the hot forming. The temperature control may be performed for example by inductive heating or by heating cartridges, to name just a few examples.

If, after the hot forming of the workpiece, the formed workpiece is quenched in the device, in particular by means of a cooling medium, the hardness structure can be set particularly cost-effectively and a cost-effective method for producing hardened components can be provided. This is possible since no additional heating of the formed workpiece or component to above the Ac1 or Ac3 temperature is necessary, since the steel material still has sufficiently high temperatures in the regions of the docking punch after it has undergone forming. Quenching is consequently possible within the device, which dispenses with the need for any additional transporting steps and quenching devices. The quenching temperature is in this case highly dependent on the steel material used. A liquid, for example water, may be provided for example as the cooling medium. However, other cooling media, such as for instance gaseous or solid cooling media, may also be used. Quenching of the workpiece is performed with preference with the docking punch withdrawn. However, it is also conceivable to introduce the cooling medium into the formed workpiece by way of the docking punch.

It goes without saying that the various possibilities presented for counteracting cooling of the workpiece in the region of the docking punch can be combined with one another.

According to a second teaching of the present invention, the object presented at the beginning is achieved by a device of the type in question for shaping a workpiece having a hollow region and consisting at least partially of a steel material, in particular for carrying out a method according to the invention, by means for counteracting the cooling of the workpiece being provided in the region of the docking punch.

The means for counteracting the cooling of the workpiece may in this case be both additional means and for example parts or particular configurations of the device itself. The means may also take the form of a certain choice of material or a certain geometrical configuration.

Consequently, as already stated with reference to the method according to the invention, the disadvantageous effect of an undesired temperature profile of the workpiece in the region of the docking punch, in particular during the hot forming, can be reduced. Thus, a satisfactory workability can be achieved also in the region of the docking punch and a substantially completely full-hardened component can be produced, so that reject material in the end region of the components can be reduced or even avoided. At the same time, with the device according to the invention even complex geometries can be advantageously produced.

The means for counteracting the cooling of the workpiece may be designed in particular in such a way that a phase transformation in the workpiece due to cooling during the hot forming of the workpiece can be substantially prevented, in other words the workpiece temperature can be kept above the recrystallization temperature or the Ac1 temperature or even the Ac3 temperature of the steel material also in the region of the docking punch.

The result is therefore that a device that allows the cost-effective production of components even with a complex geometry and at the same time makes satisfactory hardening of the components possible can be provided.

The device may also have further means for carrying out previously described method steps. For example, the device may have means for heating up or cooling the workpiece. For example, the device may have heating elements, for instance induction coils, or means for introducing a cooling medium.

According to a refinement of the device according to the invention, at least one heating element for heating the workpiece in the region of the docking punch is provided as means for counteracting the cooling of the workpiece. It has been found that, by heating the workpiece in the region of the docking punch, in particular during the hot forming, excessive or overly rapid cooling of the workpiece in this region can be sufficiently counteracted in spite of a simultaneous removal of heat by way of the device, for instance the docking punch.

According to a next refinement of the device according to the invention, means for reducing the heat transfer from the workpiece to the device are provided as means for counteracting the cooling of the workpiece. Providing the means for reducing the heat transfer can achieve the effect that less heat is removed from the workpiece in the region of the docking punch by way of the docking punch, in order in this way to counteract cooling.

According to a refinement of the device, means for reducing the thermal conductivity of the device in the region of the docking punch are provided as means for reducing the heat transfer. Corresponding means may be for instance additives or spacers, which are provided in the region of the docking punch and may be formed either as parts of the device itself or as additional elements. Means for reducing the thermal conductivity of the device in the region of the docking punch allow the heat transfer to be reduced in spite of a possibly existing temperature difference between the device in the region of the docking punch and the workpiece in the region of the docking punch.

In particular, the device may have a material with low thermal conductivity in the region of the docking punch, in particular the docking punch and/or the mold in the region of the docking punch, as means for reducing the thermal conductivity. Possible materials with low thermal conductivity are for example a tool steel with low thermal conductivity or a ceramic.

A reduced thermal conductivity or a material with low thermal conductivity is understood in particular as meaning a thermal conductivity which is lower than that of the steel material used. For example, the thermal conductivity of the material with low thermal conductivity is lower than 40, preferably lower than 30 or even lower than 20 W/(m*K).

The heat transfer can also be advantageously reduced if, according to a further refinement of the device, an additive is introduced between the workpiece and the device, in particular the mold, as means for reducing the heat transfer. Such an additive may for example be a lubricant, which may be provided on the device or the workpiece.

The heat transfer can also be advantageously reduced if, according to a next refinement of the device, the contact area between the workpiece and the device is reduced, in particular the surface of the docking punch is geometrically modified and preferably has a structuring, in particular one or more clearances, as means for reducing the heat transfer. The reduced contact area is provided with preference in the sealing region of the docking punch. Alternatively or in addition, the mold may also be geometrically modified in such a way in the region of the docking punch.

If, according to a further refinement of the device, means for reducing the temperature difference between the device and the workpiece in the region of the docking punch are provided as means for reducing the heat transfer, heat transfer can be achieved independently of the thermal conductivity of the regions of the device and the workpiece in the region of the docking punch that are in contact.

According to a further refinement of the device, a temperature-controlled docking punch and/or a mold that is temperature-controlled in the region of the docking punch may be provided particularly easily as means for reducing the temperature difference. The temperature control may be performed for example by means of induction coils or heating cartridges. Likewise, fluids that can heat the docking punch and/or the mold in the region of the docking punch may be used.

Finally, the device can be advantageously developed by the docking punch being movable. As a result, not only the docking punch can be reliably sealed off with respect to the workpiece almost independently of the workpiece geometry, but also cooling or quenching of the formed workpiece can be facilitated, since flushing by means of a cooling medium, for example water, can be performed in an easy way with the docking punch withdrawn.

FIG. 1 shows in a sectional view a part of a first exemplary embodiment of a device 1 for shaping a workpiece 2 for producing a shaped component. The workpiece 2 consists of a hardenable steel and is in this case a tubular workpiece, which is to be formed into a tubular profile. The workpiece 2 also has a hollow region 2*a*. The device 1 comprises a mold 4, which has two shaping die halves 4*a* and 4*b*, and an axially movable docking punch 6. The shape of the profile to be produced is determined by the shaping inner circumferential surfaces of the die halves 4*a* and 4*b*. The workpiece 2 has already been introduced into the mold 4, wherein the opening of the hollow region 2*a* of the workpiece 2 has been sealed closed by the docking punch 6. For this purpose, the docking punch 6 lies with its surface 6*a*, configured as a sealing region, right up against the inner circumferential surface in the end region of the workpiece 2. The docking punch 6 is adapted to the workpiece 2 for this purpose and is in this case formed substantially as rotationally symmetrical and conically tapering. For introducing a fluid into the hollow region 2*a* for the shaping of the workpiece, the docking punch 6 has a coaxially arranged fluid feeding 8.

The device may also have for example a second or further docking punch(es), with which a second opening or further openings of the tubular workpiece 2 are sealed off (not represented). However, by way of example, only one docking punch 6 is described.

Already before it is introduced into the mold 4, as represented in FIG. 1, for example, the workpiece 2 may be brought to a temperature above the Ac3 temperature. Alternatively, the workpiece 2 may however also only be heated when it is in the mold 4.

If a hot fluid, for example above the Ac1 temperature, is then introduced by means of the fluid feeding 8 into the hollow region 2*a* of the workpiece 2 fixed in the mold 4, the workpiece 2 can be hot-formed in cooperation with the shaping die halves 4*a*, 4*b*. In this case, the forming may be brought about by the fluid introduced under high pressure or by a bringing together of the die halves 4*a*, 4*b* with a fluid introduced under moderate pressure. Likewise, a combination of these methods may be provided.

In order to assist the forming, the docking punch 6 also has the projection 6*b*, which engages behind the workpiece. In this way, material of the workpiece 2 can be displaced into the region between the die halves 4*a*, 4*b*, so that it can be ensured that enough material is available in regions where there are high degrees of forming.

As already described, the docking punch 6 in any event lies with the sealing region 6*a* against the inner circumferential surface in the end region of the workpiece 2 during the forming. In the case of devices and methods from the prior art, however, this would have the effect that a not inconsiderable heat transfer would take place from the heated workpiece 2 to the docking punch 6 and result in a cooling of the workpiece 2 in this and adjacent regions.

In order to counteract the cooling of the workpiece 2 in the region of the docking punch 6, therefore, to reduce the heat transfer from the workpiece 2 to the device 1, the device 1 has means for reducing the temperature difference between the docking punch 6 of the device 1 and the workpiece 2 in the form of a docking punch 6 that is temperature-controlled by way of heating elements 10. The heating elements 10 may for example take the form of heating cartridges or an active temperature control. The docking punch may for example be brought by the heating elements 10 to a temperature above the Ac1 or Ac3 temperature. This has the effect of preventing a phase transformation of the steel material during the hot forming due to cooling in the region of the docking punch.

By subsequent cooling or quenching of the workpiece 2 that has undergone forming, a hardening can therefore take place, in particular also in the region of the docking punch 6, without renewed heating of the workpiece being necessary.

Alternatively, the heating element 10 may for example also be formed as an induction coil, so that primary heating of the mold 2 is achieved in the region of the docking punch 6. In this case, the temperature difference between the docking punch 6 and the workpiece 2 is not necessarily reduced, but cooling of the workpiece 2 in the region of the docking punch 6 is in any event counteracted by the heating of the workpiece 2 in the region of the docking punch 6.

For hardening, after the hot forming of the workpiece 2 into a profile, the docking punch 6 may be removed, for example in the axial direction, so that the profile produced can be hardened by introducing a cooling medium.

In this way, improved workability can be achieved in the region of the docking punch 6 and a substantially completely full-hardened component can be produced, so that reject material as a result of unhardened regions of the workpiece from the region of the docking punch 6 can be reduced. At the same time, the production of hollow profiles with a complex geometry can be achieved. Moreover, a displacement of the material of the workpiece 2 from the region of the docking punch 6 is made easier as a result of the reduced cooling of the workpiece 2, so that high degrees of forming of the workpiece 2 can be achieved.

Figure 2:
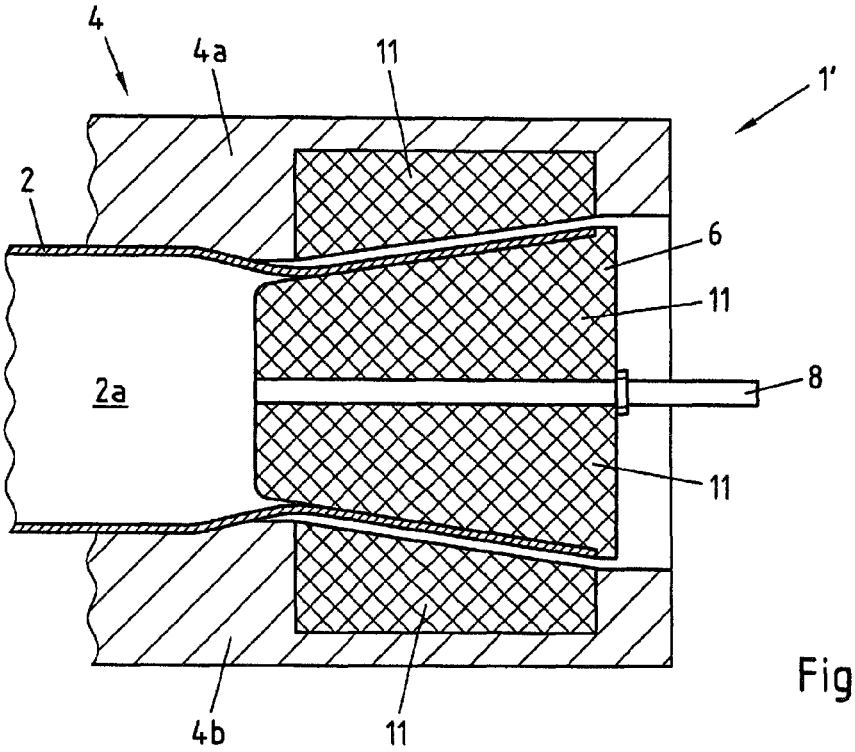
FIG. 2 is a sectional view of an example device used for producing a shaped component, the device including a mechanism for reducing thermal conductivity of an example docking punch and mold.

FIG. 2 shows a second exemplary embodiment of a device 1', which is similar to the device 1 from FIG. 1. To this extent, hereinafter only the differences are discussed and the same or similar elements are provided with the same designations. As a difference from the device 1 from FIG. 1, the device 1' from FIG. 2 does not have any means for reducing the temperature difference between the workpiece 2 and the device 1', but instead has means for reducing the thermal conductivity of the docking punch 6 and the mold 4 in the region of the docking punch 6. In this case, the means are provided by both the mold 4 in the region of the docking punch 6 and the docking punch 6 itself comprising a material 11 with low thermal conductivity. In this case, the docking punch 6 consists of a tool steel 11 or a ceramic with low thermal conductivity and the dies 4*a*, 4*b* likewise comprise a tool steel 11 or a ceramic with low thermal conductivity in the region of the docking punch 6, as identified by the cross-hatched region. In this way, the heat transfer from the workpiece 2 to the device 1' can likewise be reduced, and ultimately cooling of the workpiece 2 in the region of the docking punch 6 can be counteracted.

Figure 3:
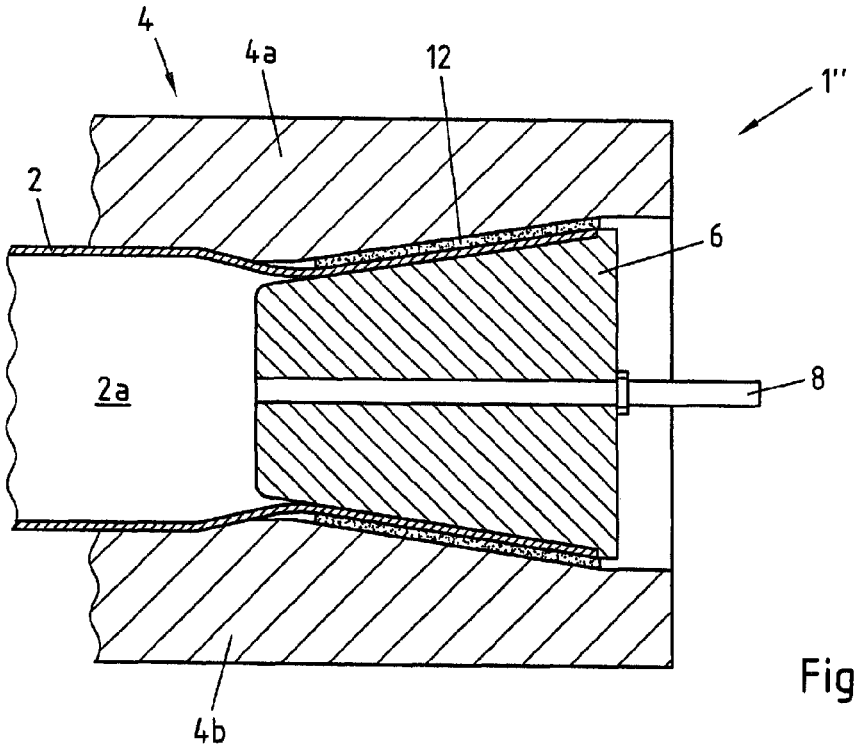
FIG. 3 is a sectional view of an example device used for producing a shaped component, the device employing an additive for reducing heat transfer.

FIG. 3 shows a third exemplary embodiment of a device 1", which is similar to the devices from FIGS. 1 and 2. In the case of the device 1" from FIG. 3, in this case an additive 12 is provided substantially in the entire region between the workpiece 2 and the dies 4*a*, 4*b* of the device 1" to reduce the heat transfer. The result is that once again the heat transfer from the workpiece 2 to the device 1" can be reduced, and ultimately cooling of the workpiece 2 in the region of the docking punch 6 can be counteracted.

Figure 4:
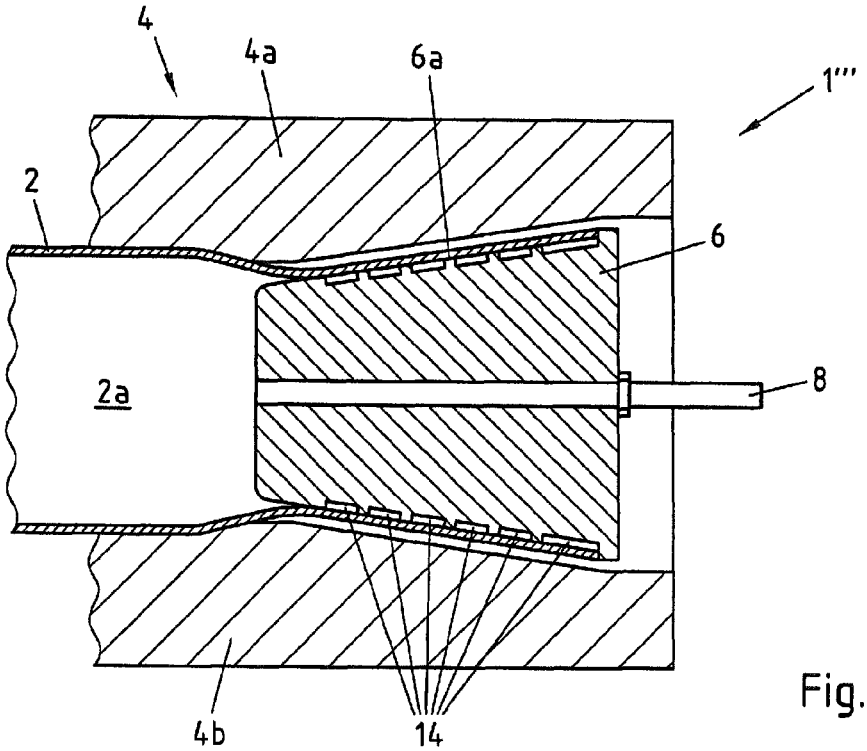
FIG. 4 is a sectional view of an example device used for producing a shaped component, the device having a reduced contact area between a workpiece and a sealing area of a docking punch.

FIG. 4 shows a fourth exemplary embodiment of a device 1''', which is designed to be similar to the previously shown devices from FIGS. 1 to 3. As a difference, however, in the region of the docking punch the means that are provided to counteract the cooling of the workpiece 2 take the form of a reduction of the contact area between the workpiece 2 and the sealing area 6*a* of the docking punch 6. This is achieved by the fact that the surface 6*a* of the docking punch 6 is geometrically modified in that a structuring in the form of clearances 14 has been introduced into the surface 6*a* configured as a sealing region of the docking punch 6. The result is that once again the heat transfer from the workpiece 2 to the device 1''' can be reduced by the reduced contact area, and ultimately cooling of the workpiece 2 in the region of the docking punch 6 can be counteracted.

Figure 5:
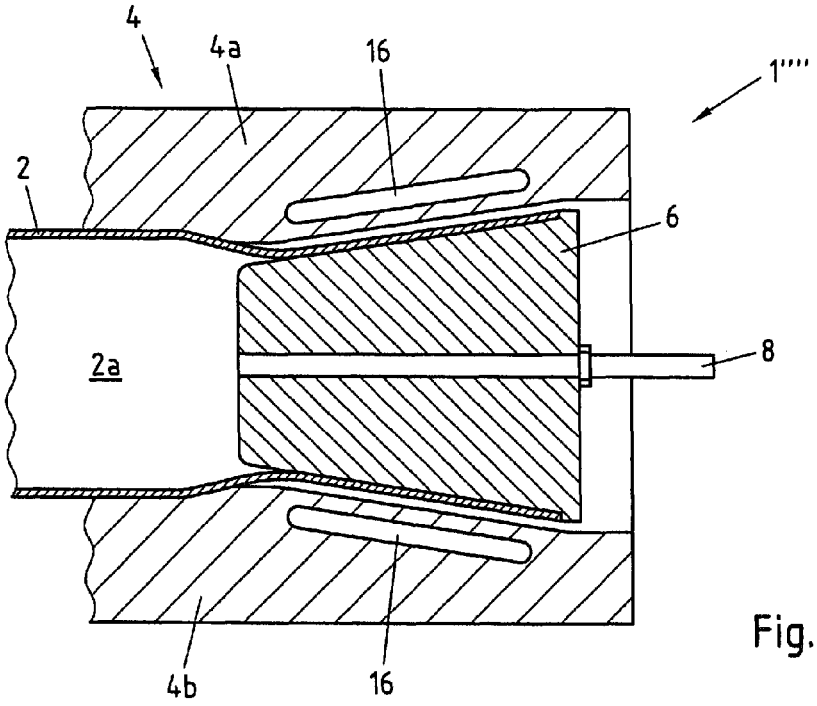
FIG. 5 is a sectional view of an example device used for producing a shaped component wherein an example mold is temperature-controlled by one or more heating elements.

FIG. 5 shows a fifth exemplary embodiment of a device 1'''', which is designed to be similar to the previously shown devices from FIGS. 1 to 4. In order to counteract the cooling of the workpiece 2 in the region of the docking punch 6, like the device 1 shown in FIG. 1, to reduce the heat transfer from the workpiece 2 to the device 1, the device 1'''' has means for reducing the temperature difference between the device 1'''' and the workpiece 2. In this case, however, not the docking punch 6 but the mold 4 is temperature-controlled by the heating elements 16, so that the temperature difference between the mold 4 and the workpiece 2 is reduced. The heating elements 16 may once again take the form of heating cartridges or an active temperature control. The docking punch may for example be brought by the heating elements 10 to a temperature above the Ac1 or Ac3 temperature. This has the effect of preventing a phase transformation of the steel material during the hot forming due to cooling in the region of the docking punch. By subsequent cooling or quenching of the workpiece 2 that has undergone forming, a hardening can therefore take place, in particular also in the region of the docking punch 6, without renewed heating of the workpiece being necessary.

Alternatively, also the heating element 16 may be formed as an induction coil, so that primarily a direct heating of the mold 2 is achieved in the region of the docking punch 6. In this case, therefore, once again the temperature difference between the mold 4 and the workpiece 2 is not necessarily reduced, but cooling of the workpiece 2 in the region of the docking punch 6 is in any event counteracted by the heating of the workpiece 2 in the region of the docking punch 6.

What is claimed is:

1. A method for producing a shaped component:

positioning a workpiece having a hollow region and consisting at least partially of steel in a mold of a device;

using a docking punch to introduce a fluid under pressure into the hollow region of the workpiece positioned in the mold;

hot-forming the workpiece in the mold; and counteracting a cooling of the workpiece in a region of the docking punch, wherein the counteracting comprises reducing heat transfer from the workpiece to the device in the region of the docking punch by reducing thermal conductivity of the device in the region of the docking punch by utilizing a material with a thermal conductivity of less than 40 W/(m*K) in the region of the docking punch.

2. The method of claim 1 wherein counteracting the cooling of the workpiece comprises heating the workpiece in the mold in the region of the docking punch.

3. The method of claim 1 wherein reducing heat transfer comprises introducing an additive between the workpiece and the mold of the device.

4. The method of claim 1 wherein reducing heat transfer comprises reducing a contact area between the workpiece and the device by modifying one or more clearances associated with a geometry of a surface of the docking punch.

5. The method of claim 1 wherein reducing heat transfer comprises reducing a temperature difference between the workpiece and the device in the region of the docking punch.

6. The method of claim 1 wherein reducing the temperature difference comprises controlling in the region of the docking punch a temperature of at least one of the docking punch or the mold.

7. The method of claim 1 further comprising quenching the workpiece in the device after the workpiece is hot formed, wherein the quenching is performed by a cooling medium when the docking punch is withdrawn.

8. A device for performing the method of claim 1, the device comprising:

a mold for receiving the workpiece;

a docking punch for introducing a fluid into the hollow region of the workpiece; and a mechanism for counteracting a cooling of the workpiece, the mechanism disposed in a region of the docking punch.

9. A device for shaping a workpiece having a hollow region and comprising a steel material, the device comprising:

a mold for receiving the workpiece;

a docking punch for introducing a fluid into the hollow region of the workpiece; and a mechanism for counteracting cooling of the workpiece, the mechanism disposed in a region of the docking punch, wherein the mechanism for counteracting cooling of the workpiece reduces heat transfer from the workpiece to the device, wherein the mechanism reduces thermal conductivity of the device in the region of the docking punch by employing a material with a thermal conductivity of less than 40 W/(m*K) in the region of the docking punch.

10. The device of claim 9 wherein the mechanism for counteracting cooling of the workpiece is a heating element that heats the workpiece in the region of the docking punch.

11. The device of claim 9 wherein the mechanism introduces an additive between the workpiece and the mold so as to reduce heat transfer from the workpiece to the device.

12. The device of claim 9 wherein a contact area between the workpiece and the device includes one or more clearances for reducing heat transfer from the workpiece to the device.

13. The device of claim 9 wherein the mechanism is a heating element that is disposed in either the docking punch or the mold, the heating element for reducing a temperature difference between the device and the workpiece in the region of the docking punch.

14. The device of claim 9 wherein the docking punch and/or the mold are temperature-controlled so as to reduce a temperature difference between the device and the workpiece in the region of the docking punch.

15. The device of claim 9 wherein the docking punch is movable.

* * * * *